United States Patent [19]

Blasi

[11] 3,937,473

[45] Feb. 10, 1976

[54] GOLF SWING TRAINING DEVICE

[75] Inventor: Alvi R. Blasi, Daly City, Calif.

[73] Assignee: The Raymond Lee Organization, Inc., New York, N.Y. ; a part interest

[22] Filed: Jan. 6, 1975

[21] Appl. No.: 539,009

[52] U.S. Cl. ..... 273/183 B; 273/188 R; 273/195 R

[51] Int. Cl.[2] ..... A63B 69/36

[58] Field of Search ..... 273/183, 188, 189, 190; 35/29 A

[56] References Cited

UNITED STATES PATENTS

| | | | |
|---|---|---|---|
| 2,954,232 | 9/1960 | Auer | 273/181 G X |
| 3,079,152 | 2/1963 | Cushing | 273/188 R |
| 3,698,721 | 10/1972 | Stewart | 273/188 R |

*Primary Examiner*—George J. Marlo
*Attorney, Agent, or Firm*—Howard I. Podell

[57] ABSTRACT

A mechanism for use in teaching a user the proper golf swing to employ. The mechanism is in the form of a platform on which a golf tee and ball may be placed, with an erect rod fastened to the base, the upper end of which is mounted to a circular band of a size to fit freely, without contact, about the body of the user while swinging a golf club on the platform to drive the golf ball off the tee. The inside of the band is fitted with contact switches which actuate an alarm signal when touched by the body of the user, indicating that the user's body was not in balance during the golf swing.

2 Claims, 4 Drawing Figures

GOLF SWING TRAINING DEVICE

SUMMARY OF THE INVENTION

My invention is a mechanism for use in teaching a user the proper golf swing to employ.

The mechanism is in the form of a platform on which a golf tee and ball may be placed, with an erect rod fastened to the base, the upper end of which is mounted to a circular band of a size to fit freely, without contact, about the body of the user while swinging a golf club on the platform to drive the golf ball off the tee.

The inside of the band is fitted with contact switches which actuate an alarm signal when touched by the body of the user, indicating that the user's body was not in balance during the golf swing.

The device may be employed on a golf driving range and designed for use by both right and left-handed golfers by the use of two tee-off positions, and by the mounting of the erect rod and attached band in either of two sockets fitted in the base.

BRIEF DESCRIPTION OF THE DRAWINGS

The objects and features of the invention may be understood with reference to the following detailed description of an illustrative embodiment of the invention, taken together with the accompanying drawings in which.

DESCRIPTION OF THE PREFERRED EMBODIMENT

Figure 1:
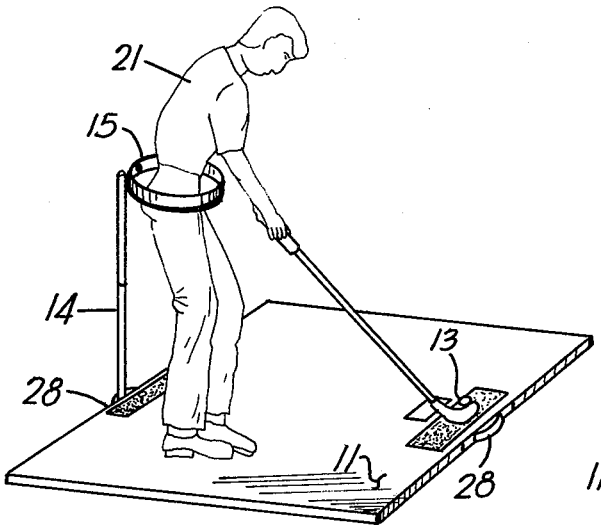
FIG. 1 is a perspective view of the invention in use.
Figure 2:
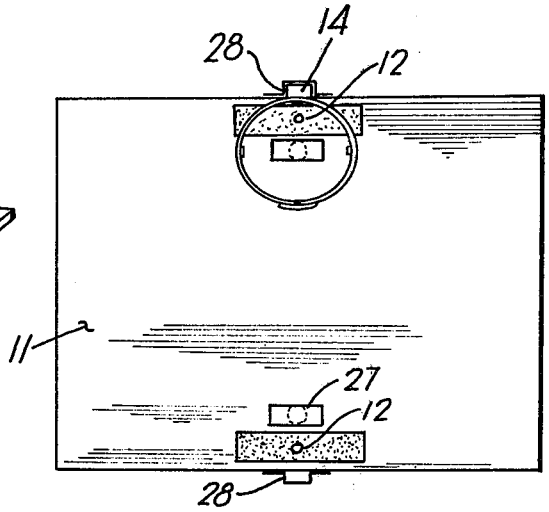
FIG. 2 is a plan view of the invention.
Figure 3:
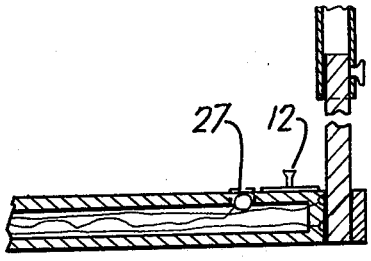
FIG. 3 is a sectional view of the base member and erect rod.
Figure 4:
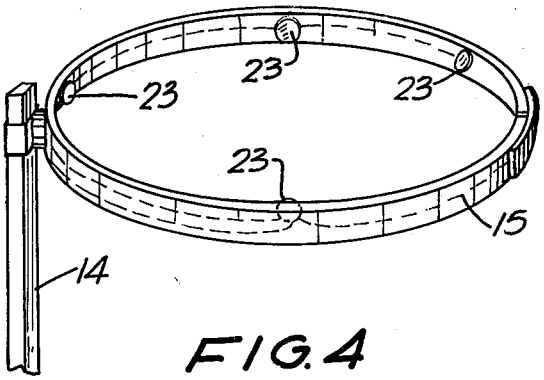
FIG. 4 is a perspective view of the circular band.

Turning now descriptively to the drawings, in which similar reference characters denote similar elements throughout the several views, FIGS. 1–4 illustrate the invention which consists of a horizontal base platform 11 on which is mounted a tee 12 and golf ball 13, with a vertical support rod 14 mounted on the opposite side, from the golf tee, to the base platform 11. A horizontal circular belt 15 is fastened to the top of support rod 14, with belt 15 of a size and shape to surround a player 21 in the act of hitting ball 13, without touching the player 21.

Contact switches 23 are mounted inside of the belt 15 to turn ON when touched by the body of the player 21, with said switches 23 connected to a source of power and to an alarm indicator such as a light bulb 27 mounted adjacent to the tee 12.

Support rod 14 may be fastened to the base platform 11 by means of a removable socket 28 so that support rod 14 may be mounted in a similar socket 28 on the opposite side of the platform 11, when a left-handed player utilizes the tee 12 L and observes the alarm signal light 27 L.

The diameter of belt 15 is set so that a correct golf swing by the player 21 will result in his body remaining out-of-contact with belt 15, while an incorrect movement of the body 21 during the golf swing will result in contacting belt 15 and a contact switch 23 and the lighting of alarm signal lamp 27.

Since obvious changes may be made in the specific embodiment of the invention described herein, such modifications being within the spirit and scope of the invention claimed, it is indicated that all matter contained herein is intended as illustrative and not as limiting in scope.

Having thus described the invention, what I claim as new and desire to secure by Letters Patent of the United States is:

1. A mechanism for teaching a golfer to swing properly comprising a horizontal platform containing a golf tee-off position near one edge of the platform and a vertical rod mounted near an opposed edge of the platform, said rod joining a circular belt of a size to fit about the waist of a golfer driving a ball from the tee-off position, without touching said golfer's waist said belt fitted with electrical switches one of which is turned ON when the belt contacts the golfer, said switches connected to an alarm signal that indicates the contact.

2. The combination as recited in claim 1 in which the alarm signal is a light bulb mounted adjacent to the tee-off position.

* * * * *